US005406891A

United States Patent [19]

Kunczynski

[11] Patent Number: 5,406,891

[45] Date of Patent: Apr. 18, 1995

[54] FUNICULAR SYSTEM INCLUDING HAUL ROPE GRIP ASSEMBLY

[75] Inventor: Jan K. Kunczynski, Glenbrook, Nev.

[73] Assignees: Zygmunt Alexander Kunczynski; Alexander Jan Kunczynski, both of Carson City, Nev.

[21] Appl. No.: 18,073

[22] Filed: Feb. 16, 1993

[51] Int. Cl.[6] ..... B61B 7/00; B61B 12/12

[52] U.S. Cl. ..... 104/173.1; 104/200; 104/202; 104/140

[58] Field of Search ..... 104/173, 182, 197, 200, 104/201, 202, 140; 198/804

[56] References Cited

U.S. PATENT DOCUMENTS

| | | | |
|---|---|---|---|
| 255,752 | 4/1882 | Abbot et al. . | |
| 332,934 | 12/1885 | Miller . | |
| 343,293 | 6/1886 | Bowen . | |
| 404,498 | 6/1889 | Pendleton et al. . | |
| 440,001 | 11/1890 | Pendleton et al. . | |
| 466,880 | 1/1892 | Hallidie . | |
| 482,279 | 9/1892 | Smith . | |
| 511,596 | 12/1893 | Earll . | |
| 530,720 | 12/1894 | Roe . | |
| 536,611 | 4/1895 | Earll . | |
| 546,955 | 9/1895 | Earll . | |
| 797,943 | 8/1905 | Crawford | 104/200 |
| 2,200,965 | 5/1940 | Morton | 104/140 |
| 2,250,339 | 7/1941 | Whittum | 104/200 |
| 2,751,218 | 6/1956 | Pass, Jr. . | |
| 2,765,753 | 10/1956 | Nixon | 104/200 X |
| 2,840,008 | 6/1958 | Lodvick et al. | 104/200 |
| 2,938,472 | 5/1960 | Tiegel . | |
| 3,221,666 | 12/1965 | Wengel | 104/173.1 |
| 3,797,407 | 3/1974 | Laurent . | |
| 4,092,929 | 6/1978 | Laurent . | |

FOREIGN PATENT DOCUMENTS

| | | |
|---|---|---|
| 701740 | 3/1931 | France . |
| 209072 | 6/1940 | Switzerland . |
| 385273 | 3/1965 | Switzerland . |
| 014208 | 8/1888 | United Kingdom . |

*Primary Examiner*—Robert J. Oberleitner
*Assistant Examiner*—S. Joseph Morano
*Attorney, Agent, or Firm*—Flehr, Hohbach, Test, Albritton & Herbert

[57] ABSTRACT

A funicular system including a passenger carriage or vehicle (21) supported for movement along a path relative to a support surface (22), an endless haul rope (23) mounted in a loop-like plurality of support sheaves (26, 27, 28) for guided movement along the path, and grip assembly (24) coupled to the carriage (21) and coupled to the haul rope (23) and formed for passage of the grip assembly (24) over the support sheaves (26, 27, 28) without significant relative displacement between the haul rope (23) and support sheaves (26, 27, 28). The grip assembly (24) preferably is comprised of a linear array of band assemblies (**41*a*–41*n*) which encircle the haul rope (23) and have a relatively thin thickness dimension. The band assemblies (41*a*–41*n*) are clamped to the haul rope by a clamp (32) and coupled by a flexible link (56) to the undercarriage (59) of the vehicle (21). The grip (24) allows the haul rope (23) to be positively contained between support sheaves (26, 27, 28) with the grip (24) passing therebetween so that the haul rope position can be used to control and guide the position of the vehicle or carriage (21). Reduction of splice length and splice fatigue also is effected by the haul rope grip assembly (21**).

14 Claims, 3 Drawing Sheets

FUNICULAR SYSTEM INCLUDING HAUL ROPE GRIP ASSEMBLY

TECHNICAL FILED

The present invention relates generally to rope driven passenger or load-carrying systems, such as funiculars and cable cars, and more particularly, relates to the grip assemblies and haul rope supporting sheave assemblies employed in such funicular systems.

BACKGROUND ART

For many years funicular or cable car systems have used one of two techniques to allow the grip assembly for the car or carriage to pass over the support sheaves for the haul rope. Most typically, the funicular haul rope is lifted from the support sheaves as the cable grip passes over the sheaves. U.S. Pat. Nos. 4,092,929 and 3,797,407 illustrate this approach in modern funicular systems, while U.S. Pat. Nos. 440,001, 511,596, 536,611 and 546,955 illustrate haul rope lateral shifting and/or lifting approaches as applied to older funicular systems.

The second approach which has been widely used is to displace the haul rope supporting sheaves away from the haul rope as the grip passes along the drive path. Thus, in U.S. Pat. Nos. 332,934 and 404,498 the rope supporting pulleys are displaced or depressed as the grip passes. In U.S. Pat. No. 482,279 both lifting of the haul rope above stationary support sheaves and displacing selected sheaves are used.

The primary disadvantage of relative displacement between the haul rope and haul rope supporting sheaves in order to allow a funicular grip to pass over the sheaves is that once the haul rope is separated from the sheaves it is not possible to control or contain the haul rope in a positive manner. Thus, in conventional funicular systems some provision must be made to guide the vehicle or car to control its position when the haul rope is no longer confined by the guide or support sheaves. In horizontal curves, for example, lifting of the haul rope requires auxiliary guide wheels or tracks and wheels having flanges that will prevent the car from pulling the rope laterally out of alignment with the guide sheaves. Moreover, any time a haul rope is lifted from a support sheave, the risk of deropement of the rope from the sheaves is increased. Still further, relative separation of the haul rope from the support sheaves and its subsequent replacement can tend to produce twisting or spinning of the haul rope, which is detrimental to the sheaves, grip assembly and haul rope itself.

A further significant disadvantage which results when haul ropes are lifted, in some cases by as much as 20 inches, is that the stresses on the car or vehicle undercarriage is substantial. Thus, undercarriages must be relatively strong and undesirably heavy to withstand this stress.

In any funicular system employing an endless, looped haul rope there will be at least one rope splice between opposite ends of the haul rope. Rope splices typically require interweaving of alternating strands from the opposed ends over a length of about 1200 rope diameters, and the effectiveness of the splice depends upon the tendency of the strands to pull in radially against each other and the ends which are positioned where the rope core normally would be. Such haul rope splices, however, tend to fatigue earlier than the remainder of the haul rope, particularly in shuttle funicular systems in which the splice passes over the bull wheels at opposite ends of the system. A common concern in funicular systems, therefore, is haul rope splice fatigue.

DISCLOSURE OF INVENTION

Accordingly, it is an object of the present invention to provide a funicular system and grip assembly for such a system which enables the haul rope grip to pass smoothly along the supporting sheaves while the sheaves positively contain and confine the haul rope to thereby control the vehicle or carriage position solely through its attachment to the haul rope.

Another object of the present invention is to provide a funicular grip assembly which allows rope splices to be reduced in length and located under the passenger carriage or car for minimum fatiguing.

A further object of the present invention is to provide an improved apparatus and method for coupling the passenger carriage of a funicular to the haul rope in a manner lessening the possibility of deropement of the haul rope from the support sheaves and in a manner providing redundancy for greater safety.

The present invention has other objects and features of advantage which will become apparent from or are set forth in more detail in the accompanying drawing and following description of the Best Mode of Carrying Out the Invention.

The funicular system of the present invention includes a carriage or vehicle supported for movement along a support surface and coupled to a haul rope by a grip assembly. The haul rope is supported for movement on a plurality of support sheaves, and the improvement in the funicular system comprises, briefly, the grip assembly being formed for passage of the grip over the support sheaves without significant relative displacement between the haul rope and support sheaves. Most preferably, the grip assembly is provided by a plurality of bands which encircle and radially inwardly grip the haul rope and are sufficiently thin for smooth, substantially jolt-free passage of the grip over the support sheaves so that support sheaves can be provided which contain and positively control the position of the haul rope over its entire length.

The method of guiding a haul rope-driven carriage in a funicular system of the present invention is comprised, briefly, of the steps of coupling the carriage to the haul rope by a grip assembly formed for passage of the grip over the support sheaves without significant relative movement, and controlling movement of the carriage along the path by positively containing the haul rope with the support sheaves.

BEST MODE OF CARRYING OUT THE INVENTION

The funicular or cable-driven vehicle system of the present invention employs a haul rope gripping assembly which allows the haul rope to remain in contact with stationary sheaves as the grip passes over and between the sheaves without any significant relative displacement of the rope and sheaves. This reduces the forces applied to the undercarriage of the vehicle or passenger carrier unit by eliminating the need to lift the haul rope from the sheaves, and it reduces or may eliminate the need for auxiliary lateral guidance of the passenger carrier unit through the use of tracks and mating flanged wheels or auxiliary control rollers or devices carried by the vehicle. The grip assembly also permits shortening and lessening of fatigue on the haul rope splice.

Figure 1:
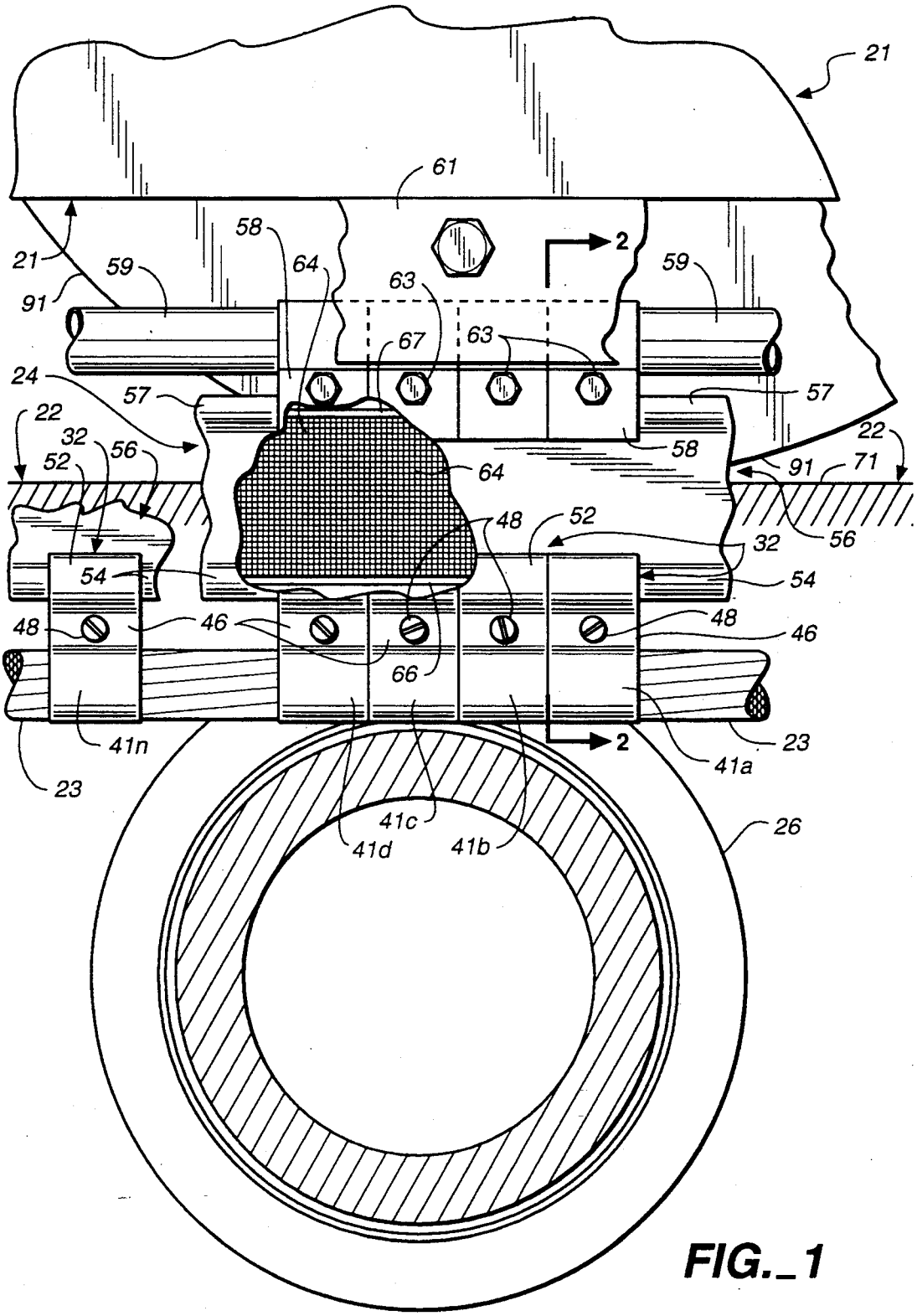
FIG. 1 is a fragmentary, side elevation partially schematic view, in cross section of a funicular system grip assembly constructed in accordance with the present invention.
Figure 3:
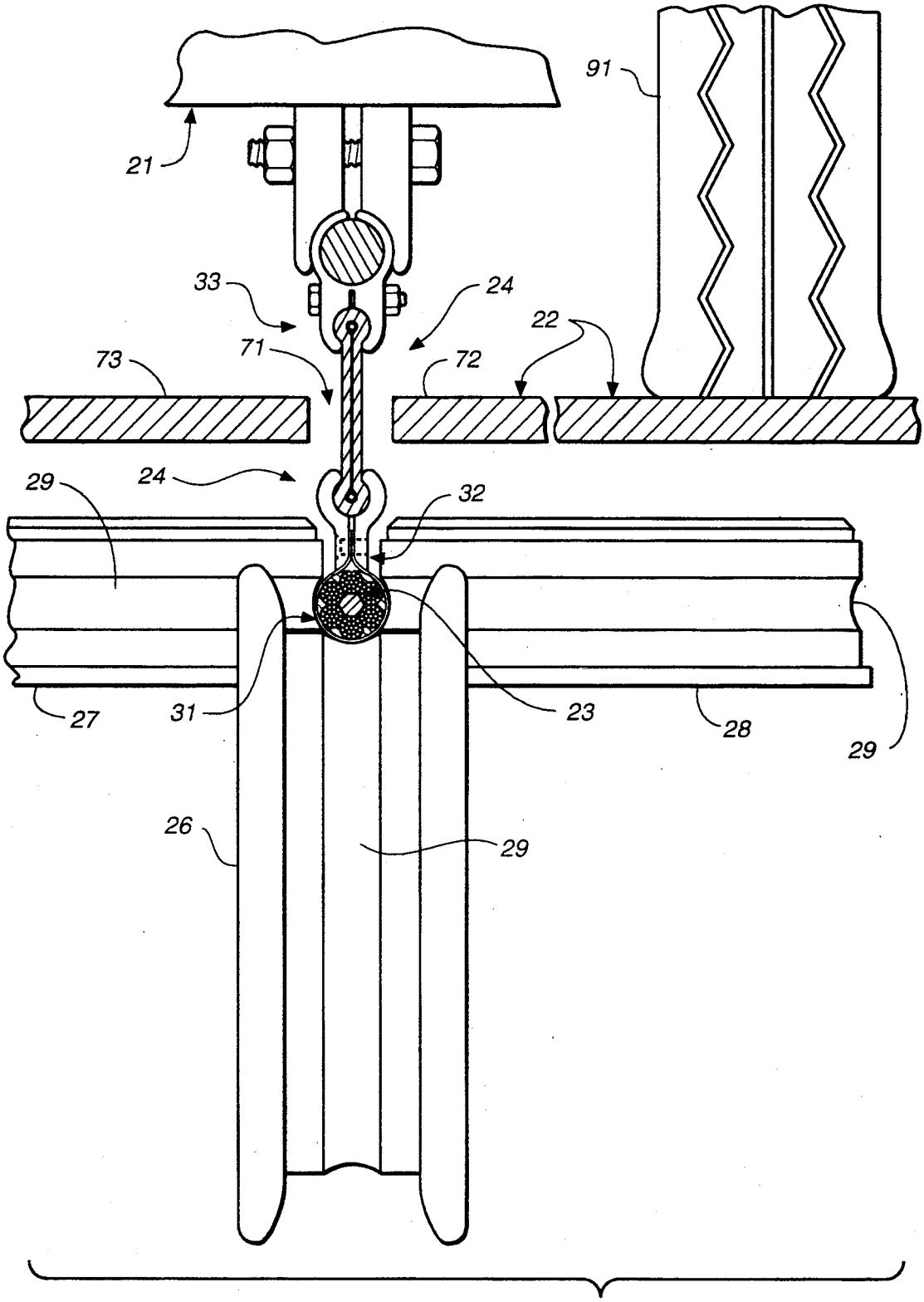
FIG. 3 is an end elevation view of the grip assembly of FIG. 1 shown as the grip passes between haul rope containing support sheaves.

The funicular system of the present invention includes a vehicle or carriage, generally designated 21 and schematically shown in FIGS. 1 and 3, which is supported for movement along a support surface, generally designated 22, by wheels or the like, such as wheel 91. Vehicle or carriage 21 is coupled to a haul rope 23 by a grip assembly, generally designated 24, for driving of the carriage along the desired path of the funicular system.

It will be understood that haul rope 23 is most usually a twisted wire rope which has opposite ends that have been joined together by a splice or dead-ended into the vehicle to form an endless loop. The endless loop will be supported by a plurality of support sheaves 26, 27 and 28 (FIG. 3) that are positioned along the desired funicular path, usually in a rope and sheave containing housing or structure under surface 22. As will be understood, however, the present system and grip assembly does not require that the haul rope and sheaves be below vehicle 21 or contained in a housing. The opposite ends of the haul rope loop will be supported on bull wheels (not shown) , at least one of which wheels will be driven so as to drive the haul rope and vehicle. As shown in the drawing and in the most preferred form of the grip assembly, the haul rope grip is designed for permanent gripping of haul rope 23 in a shuttle-type funicular system in which carriage 21 moves between end terminals in one direction and then is reversed to move in the opposite direction between the end terminals. Such shuttle funiculars, their drive and idler bull wheels, and rope splices are well known in the prior art and will not be described in detail.

It is highly desirable to be able to positively contain or control the position of haul rope 23 as it moves along the funicular drive path. As best may be seen in FIG. 3, three stationary support sheaves 26–28 may be used to engage haul rope 23 and thereby confine the position of the haul rope very positively and accurately between the sheaves. All three support sheaves have grooves 29 which are concaved to mate with and receive the periphery of haul rope 23. Horizontally oriented sheaves 27 and 28 can be positioned upstream or downstream relative to sheave 26, but in close proximity thereto, so as to virtually surround and very positively contain and control the haul rope. While this is highly desirable, particularly when the funicular path includes horizontal and/or vertical curves, it also requires a haul rope grip assembly 24 which will pass between the assemblies of sheaves such as sheaves 26–28 without any significant relative displacement between the haul rope and sheaves so as to maintain positive containment and control of the position of the haul rope.

Accordingly, grip assembly 24 of the present invention is formed with band means, generally designated 31, which encircles haul rope 23 and is sufficiently thin to pass between sheaves 26–28 without significant relative movement between the sheaves and the haul rope while the haul rope is supported on and confined for movement between the sheaves. Such passage should be substantially jolt-free so as not to fatigue the respective components or be uncomfortable to passengers in vehicle 21. Band means 31 in grip assembly 24 is clamped against rope 23 by clamping means, generally designated 32, which produces a radial-inward gripping force of the band means against the haul rope. Grip assembly 24 also includes mounting means, generally designated 33, by which the grip assembly is mounted to carriage or vehicle 21.

As set forth below, band means 31 typically will have a thickness less than 5 millimeters and preferably only 3 millimeters, which is on the order of 10 percent or less of the haul rope diameter. Haul rope 23, for example, may have a diameter of 15/8 inches. The thin band means allows the grip to pass without displacing the haul rope away from the sheaves by a significant amount, or visa versa, and jarring or jolting or excessive vibration does not occur when the grip moves over or between sheaves 26–28.

Figure 2:
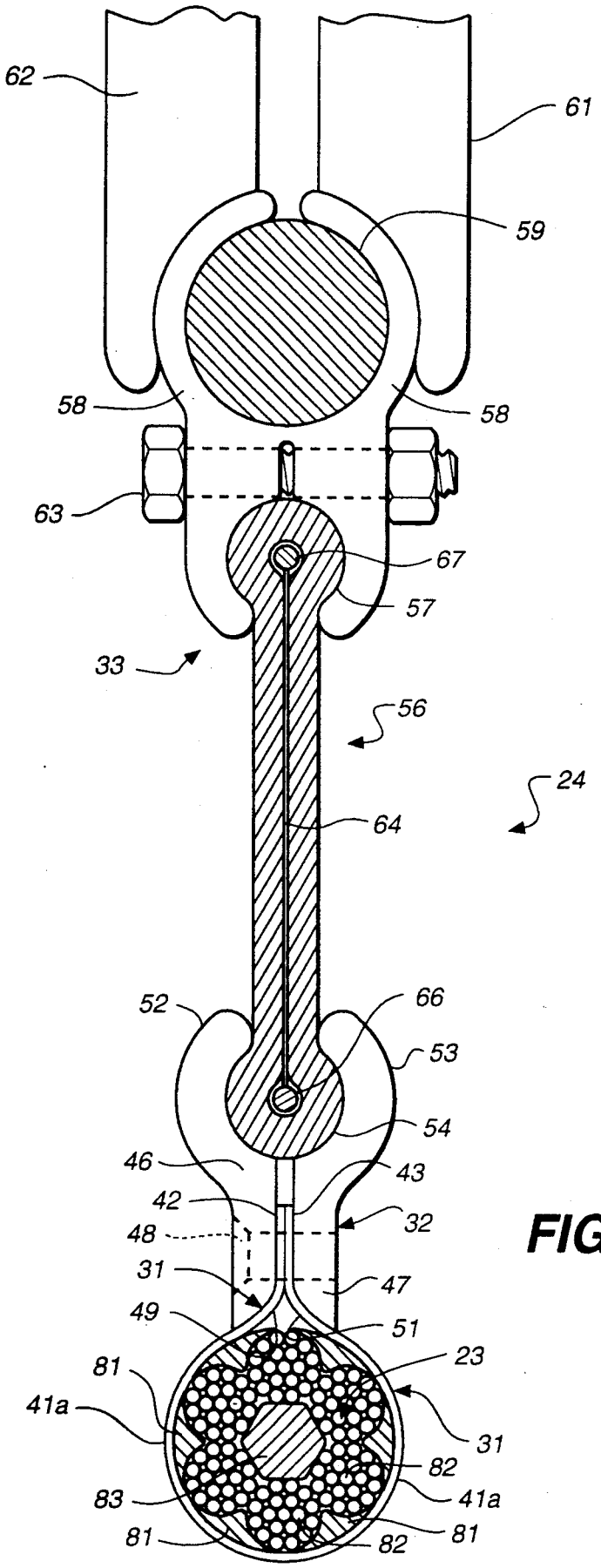
FIG. 2 is an enlarged, fragmentary, end elevation view, in cross section of the grip assembly of FIG. 1, taken substantially along the plane of line 2—2 in FIG. 1.

Referring to FIGS. 1 and 2, the details of construction of grip assembly 24 can be described. In the preferred form of the present invention and in order to provide redundancy and ease of replacement, grip assembly 24 includes a plurality of side-by-side band assemblies 41*a*, 41*b*, 41*c*, 41*d* . . . 41*n*, each of which encircle haul rope 23 and have a relatively thin thickness dimension. As will be seen in FIG. 1, therefore, bands 41*a*–41*n* form a linear grip coupling or array along haul rope 23, which may extend over the full length of vehicle 21 or even beyond the vehicle. The inner ends 42 and 43 (FIG. 2) of each band assembly extend into clamping means 32, which may be advantageously formed by a pair of clamping members 46 and 47 joined together by an individually actuatable clamping member such as a fastener 48. Fastener 48 passes through openings in inner ends 42 and 43 of the band assemblies 41*a*–41*n*. As the clamping members 46 and 47 are drawn towards each other by fastener 48, the curved clamping surfaces 49 and 51 draw the ends 42 and 43 of the band together. The length of the band to the opening through which fastener 48 passes is such that clamping assembly 23 tensions the band so as to produce a radial compression and gripping of rope 23. In a prototype a band tension of about 3–400 pounds was generated by clamps 32.

In order to provide redundancy, it is most preferable that each band assembly 41*a*–41*n* be provided by a plurality of relatively thin, concentrically-mounted bands. In the most preferred form, each band assembly is comprised of three 1 millimeter thick, spring quality, stainless steel band members. The length of the band members along haul rope 23 preferably is less than about four haul rope diameters, and most preferably, is less than about two haul rope diameters. Accordingly, there will typically be at least fifty and perhaps as many as two hundred band assemblies 41*a*–41*n* clamped to haul rope 23 by clamping assemblies 32. For a vehicle 20 feet in length, for example, grip assembly 24 will include 120 side-by-side band assemblies each two inches in length and separated by one millimeter or less from each other.

The use of a plurality of side-by-side clamping assemblies 41*a*–41*n* provides great reliability by increasing redundancy and lowering the traction load on any one band assembly. Thus, each clamping assembly to be designed to transfer only a small portion of the total drive force from the haul rope to carriage 21. In a typical grip assembly, for example, the traction load transferred by each one of the gripping bands 41*a*–41*n* will be under about fifty pounds or twenty-five pounds per inch. The use of a plurality of band assemblies to form band means 31 insures less fatigue and reduces slipping of the grip relative to the haul rope. It is possible, however, to use a single longitudinally extending band or band assembly (concentric band members) within the scope of the present invention.

In the preferred form, individual band clamping assemblies 32 will be seen to also have inner ends 52 and 53 which will simultaneously clamp against enlarged end 54 of a flexible link, generally designated 56. Thus, as threaded fastener 48 is screwed down inside the threaded bore in clamping member 47, ends 52 and 53 are pulled down against the longitudinally extending enlarged end or rib 54 of link 56, while opposite clamping member ends 49 and 52 pull down against the concentric band members comprising band assemblies 41*a*–41*n*.

In connection with clamp means 48, it should also be noted that the combined thickness of clamping members 46 and 47, and two thicknesses of band assembly 41*a*, proximate haul rope 23 should be less than the diameter of haul rope 23. As will be seen from FIG. 3, this allows the clamping assembly 32 to pass freely between horizontal sheaves 27 and 28 while haul rope 23 is fully seated in grooves 29 of the sheaves.

In order to transmit the haul rope traction force to the passenger carriage or vehicle 21, it is preferable that grip assembly 24 further includes a mounting assembly 33 which is sufficiently flexible to accommodate some vertical displacement and lateral misalignment, but at the same time is sufficiently stiff so as to transmit the traction force. Thus, in the preferred form, flexible link means 56 is coupled to clamping assembly 32 at end 54 and is coupled at a second end 57 to a mounting clamp 58. Clamp 58 is mounted on and clamped around longitudinally extending rod or bar 59 secured by mounting brackets or fingers 61 and 62 to the undercarriage of vehicle 21. A fastener 63 can be employed to simultaneously clamp the mounting clamp to link 56 and undercarriage rod 59. Rod 59 can be mounted by various means to the undercarriage, but is here shown as a one and one-half inch diameter rod mounted by bracket or fingers 61 and 62 which clamp over the outside of mounting clamp members 58.

In order to provide the necessary longitudinal stiffness along haul rope 23, it is preferable that flexible link means 56 be provided as a single, continuous extruded elastomeric link with longitudinally extending enlarged ribs or ends 54 and 57, which are received in the respective individual clamping structures. Thus, a plurality of bands 41*a*–41*n* are clamped to rib 54 and a plurality of side-by-side mounting clamps 58 are clamped to the upper longitudinally extending rib 57.

It is further preferable that flexible link 56 be formed of a resiliently flexible elastomeric material, such as polyurethane, which has a reinforcing sheet or fabric layer 64 embedded therein. Layer 64 can extend and optionally be secured to enlarged string or rope-like end members 66 and 67, which extend down the center of the ribs 54 and 57. In the preferred form, the composite/elastomeric flexible link 56 is a 4 inch high strap formed from a material such as polyurethane having a durometer of about 50–55 on the Schorr A Scale and reinforced by a fiberglass, KEVLAR or even a metal fabric mesh or sheet 64. The reinforcing sheet withstands the majority of the traction load, and multiple sheets and various fiber orientations can be used to provide the desired strength.

The flexible link coupling to undercarriage bar 59, therefore, will allow some lateral displacement, for example, within gap 71 between the members 72 and 73 defining the longitudinal slot along which the vehicle is propelled by haul rope 23. Similarly vertical displacement also is permitted by link 56. Link 56 could also be provided as separate links between individual clamps 32 and clamps 58, but some inefficiency or transferring the traction force would occur.

In order to enhance gripping of haul rope 23, it is further preferable that grip assembly 24 include a plurality of compressible gripping strips, such as, extruded elastomeric strips 81, having triangular cross sections, (FIG. 2) which are mounted in the grooves between individual strands 82 used to form the rope. In a typical twisted strand haul rope, six strands 82 are twisted about a central elastomeric or fiber core 83, with the result that there are spiral recesses or grooves along the outside periphery of the rope. The extruded elastomeric strips of resiliently compressible material, such as polyurethane, can be laid individually in a spiral configuration along haul rope 23 underneath the gripping band assembly 41*a*–41*n*. The extruded elastomeric strips 81 can be temporarily held in place until the bands are clamped around them.

Thus, when the gripping bands 41*a*–41*n* are clamped down by clamping assembly 32, they radially compress strips 81 against strands 82 even in the areas which would normally would be out of contact with bands 41*a*–41*n*. Each band assembly 41*a*–41*n* effectively is clamped around about 330 degrees of the circumference of haul rope 23, which greatly enhances the uniform, radially inward, compressive force applied to the haul rope.

Uniform radial inward compression of haul rope 23 has an additional advantage. It allows the splice between the respective ends of the haul rope to be reinforced and/or shortened and to be positioned underneath the funicular grip so that the splice does not have to pass over the end bull wheels in the funicular system. Typically, a haul rope splice is formed by interweaving or running in alternate strands 82 of one end of the haul rope with alternate strands 82 of the other end, in a manner which is well known in the art. Ends of the strands also are crossed and positioned where core 83 normally occurs. When the haul rope is tensioned, the interwoven strands are pulled down on each other and the centrally positioned ends, if the length of the interweaving of strands is sufficiently long, for example, 1200 rope diameters, the splice will hold.

The tension force in the haul rope causes the strands to tend to pull together or compress radially and thereby prevent the splice from pulling apart. Grip assembly 24 of the present invention can advantageously be mounted over the rope splice so as to extend over at least a portion of the length of the splice and apply an inward gripping or compression force that insures that the interwoven alternate strands cannot pull apart. This allows either greater reliability in splices of the same length or an ability to shorten the splice. It is believed that one may be able to reduce the rope splice length by as much as one-half, or possibly more, using the grip assembly of the present invention.

Additionally, sheaves 26, 27 and 28 are typically used to bend haul rope 23 through horizontal curves having a minimum radius of about three hundred feet and vertical curves having a minimum radius of about five hundred feet. The end bull wheels used to drive the haul rope, by contrast, may range in diameter from 40 to 80 times the rope diameter. A rope splice which passes over one of the end terminal bull wheels, therefore, is subjected to much greater stress than a splice which has to pass along the support sheaves between the bull wheels. Thus, an additional advantage of the funicular grip assembly of the present invention is that clamping the same over the haul rope at the rope splice results in a substantial portion of the rope splice being beneath the vehicle. In a shuttle system, therefore, the splice may not need to pass around either of the bull wheels at the end terminals. Fatiguing of splices, therefore, is greatly reduced by the funicular grip assembly of the present invention. It is believed that this factor alone could increase the life of the haul rope by as much as three hundred percent.

It is also highly desirable to be able to attach the carriage or vehicle 21 to a tensioned haul rope, rather than dead-ending the haul rope to the vehicle. Such dead-end configurations pass rope tension to the vehicle frame, which is not desirable, and the grip system of the present invention allows anchoring of each carriage or vehicle to a highly tensioned rope to thereby simplify coupling long trains with multiple car configurations to the haul rope.

One of the most important features of the funicular system and gripping assembly of the present invention is that it permits the haul rope to be used as a lateral guidance element for carriage or vehicle 21. As can be seen in FIG. 3, therefore, vehicle 21 can be supported by support wheels 91 from surface 22. The wheels 91 may not need to be flanged wheels which mate with a track so as to provide lateral resistance to movement or deviation of the vehicle from the desired path between end terminals. In a typical cable car system, of course, the car includes flanged wheels which ride a track that provides lateral control or guidance for the car. In other systems auxiliary rollers or wheels ride a guide rail or surface, particularly in areas which the haul rope is lifted from the support sheaves.

In the present invention, combinations of sheaves 26, 27 and 28 can be used to very precisely and positively control the location of haul rope 23. Grip assembly 24 can pass along between the sheaves without requiring displacement of the haul rope to any significant degree relative to the sheaves. This allows the grip assembly and haul rope to guide vehicle 21 and reduce or even eliminate the need for lateral guidance tracks, flanges, auxiliary rollers and the like. Additionally, since the haul rope never leaves the sheaves, it is easier to adjust and monitor the rope position with standard rope position detecting apparatus, and the deropement of the haul rope from the sheaves and spinning of the haul rope are less likely to occur.

The flexible grip and linear coupling assembly for the funicular system of the present invention, therefore, allows two improved methods for guiding a haul rope-driven carriage to be accomplished. Thus, the method of the present invention includes the steps of coupling the vehicle or carriage or 21 to a haul rope 23 by a grip assembly which is formed for passage of the grip assembly over the haul rope supporting sheaves 26, 27 and 28, without significant relative movement or displacement between the sheaves and the haul rope, while the haul rope is still supported on and confined for movement by the sheaves. Additionally, the method includes a step of controlling the movement of carriage 21 along the path by controlling the path of movement of haul rope 23 by positively confining the haul rope between the rope supporting sheaves along the desired path, such as sheaves 26–28.

The present apparatus also enables one to practice a method of reducing splice fatigue in the splice joining opposite ends of a haul rope into an endless loop. This method is comprised of the steps of mounting a grip assembly 24 to haul rope 23 at a spliced position, and radially compressing haul rope 23 with grip assembly 24 over the length of the splice to prevent separation of the spliced ends.

Accordingly, the improved flexible grip and linear coupling assembly for a funicular of the present invention provides a system in which is greatly increased reliability of guiding of the haul rope, the vehicle undercarriage is simplified and weight is reduced, haul rope splice fatigue and splice length are reduced, and auxiliary guidance of the vehicle or carriage is not required. A prototype grip, as shown in the drawing, for example, has been cycled at 120 percent of its nominal load for 3 million cycles and no slipping or fatigue were detected.

What is claimed is:

1. A grip assembly for coupling a carriage to a haul rope comprising:

a plurality of side-by-side closely proximate band assemblies each formed to encircle said haul rope, said band assemblies having a thickness dimension sufficiently small to pass relatively smoothly over a rope supporting sheave;

a clamping device coupled to each of said band assemblies and formed to tension said band assemblies to produce a radial inward gripping force in each of said band assemblies against said haul rope sufficient to effect frictional securement of said band assemblies to said haul rope for transmission of traction forces from said haul rope to said band assemblies; and a flexible link member extending in a longitudinal direction along said haul rope, said band assemblies each being secured to said link member along a longitudinally extending edge thereof, said link member further being formed for coupling of said grip assembly to said carriage, and said link member being flexible in a direction transverse to said haul rope and having sufficient stiffness and strength in a direction along said haul rope to transmit traction forces from said band assemblies to said carriage.

2. The grip assembly as defined in claim 1 wherein, said band assemblies are connected to said vehicle by a link member having a thickness dimension in an area proximate said support sheaves less than the diameter of said haul rope.

3. The grip assembly as defined in claim 1 wherein, said haul rope is formed from a plurality of twisted strands defining a plurality of spiral grooves extending along said haul rope;

said grip assembly includes a compressible grip-enhancing material positioned in said grooves at said grip assembly, and said plurality of side-by-side band assemblies encircle said haul rope and said grip-enhancing material; and said clamping device is provided by a plurality of individually actuatable clamping assemblies formed for producing a radial gripping force in said band assemblies against said haul rope and said grip-enhancing material.

4. The grip assembly as defined in claim 1 wherein, said band assemblies include at least 50 individual band assemblies each having a length along said haul rope less than about 5 haul rope diameters, and said clamping device includes an individually actuatable clamping assembly for each of said band assemblies.

5. The grip assembly as defined in claim 1 wherein, said band assemblies each include a plurality of concentric band members encircling said haul rope.

6. The grip assembly as defined in claim 1 wherein, said band assemblies each have a thickness dimension less than about five millimeters.

7. The grip assembly as defined in claim 1 wherein, said band assemblies are each comprised of a plurality of concentric band members each having a thickness of about one millimeter.

8. A grip assembly for a haul rope driven carriage comprising:

a plurality of side-by-side band assemblies each formed to encircle said haul rope and having a thickness dimension sufficiently small to pass relatively smoothly over a rope supporting sheave without significant relative deflection between said haul rope and said sheave;

a clamping structure coupled to said band assemblies and formed to circumferentially tension said band assemblies to produce a radial inward gripping force in said band assemblies against said haul rope; and a mounting assembly including a longitudinally flexible sheet-like member connected along one edge thereof to said plurality of band assemblies and formed for coupling of said grip assembly to said carriage, said sheet-like member being flexible in a direction transverse to said haul rope and having sufficient strength and stiffness along said haul rope to transmit traction forces from said haul rope to said carriage.

9. The grip assembly as defined in claim 8 wherein, said clamp structure is provided as an individual clamp assembly for each of said band assemblies, said clamp assembly clamping each of said band assemblies against said haul rope and to said sheet-like member.

10. The grip assembly as defined in claim 8 wherein, said sheet-like member is provided as a resiliently flexible elastomeric member having a reinforcing fabric sheet embedded therein.

11. The grip assembly as defined in claim 8 wherein, said sheet-like member is coupled to said carriage by a mounting assembly secured to said sheet-like member along an edge thereof opposite said one edge.

12. The grip assembly as defined in claim 11 wherein, said mounting assembly further includes a plurality of side-by-side mounting clamps each secured to said sheet-like member along said edge thereof opposite said one edge and each formed for mounting to a longitudinally extending member carried by said carriage.

13. The grip assembly as defined in claim 8 wherein, said grip assembly further includes a radially compressible grip-enhancing material positioned between said band assemblies and said haul rope.

14. The grip assembly as defined in claim 13 wherein, said grip-enhancing material is provided by a plurality of longitudinally and spirally extending strips of elastomeric material.

* * * * *

UNITED STATES PATENT AND TRADEMARK OFFICE

CERTIFICATE OF CORRECTION

PATENT NO. : 5,406,891

DATED : April 18, 1995

INVENTOR(S) : Kunczynski

It is certified that error appears in the above-indentified patent and that said Letters Patent is hereby corrected as shown below:

Column 4, line 23, delete "15/8" and insert therefore --1 5/8--.

Signed and Sealed this

Twenty-seventh Day of June, 1995

Bruce Lehman

*Attest:*

BRUCE LEHMAN

*Attesting Officer*

*Commissioner of Patents and Trademarks*